United States Patent [19]

Heinen et al.

[11] 4,314,391

[45] Feb. 9, 1982

[54] YARN BULKING JET

[75] Inventors: Peter Heinen; Peter Gossens, both of Heinsberg-Oberbruch, Fed. Rep. of Germany

[73] Assignee: Akzona Incorporated, Asheville, N.C.

[21] Appl. No.: 106,771

[22] Filed: Dec. 26, 1979

[30] Foreign Application Priority Data

Dec. 27, 1978 [DE] Fed. Rep. of Germany ..... 2856290

[51] Int. Cl.[3] ..... D02G 1/16

[52] U.S. Cl. ..... 28/273

[58] Field of Search ..... 28/254, 257, 271, 273

[56] References Cited

U.S. PATENT DOCUMENTS

| | | | |
|---|---|---|---|
| 2,924,868 | 2/1960 | Dyer | 28/273 |
| 3,010,270 | 11/1961 | Richmond et al. | 28/273 |
| 3,110,950 | 11/1963 | Yamamoto | 28/273 |
| 3,169,296 | 2/1965 | Clendening, Jr. | 28/257 |
| 3,545,057 | 12/1970 | Lubach | 28/273 |
| 3,577,614 | 5/1971 | Price | 28/273 X |
| 4,099,308 | 7/1978 | Wesley | 28/273 |
| 4,217,323 | 8/1980 | Foster et al. | 28/271 X |

FOREIGN PATENT DOCUMENTS

| | | | |
|---|---|---|---|
| 51-55450 | 5/1976 | Japan | 28/257 |

*Primary Examiner*—Robert Mackey

*Attorney, Agent, or Firm*—Francis W. Young; Tom R. Vestal

[57] ABSTRACT

A bulking device for making loop yarn, comprising a base with a blowing chamber, a pin insert with a yarn feeding channel and a jet insert with a yarn delivery channel, followed by a diffusor, the axis of which runs at an angle to the jet axis and which is followed by a cylindrical channel section.

4 Claims, 2 Drawing Figures

YARN BULKING JET

The invention herein relates to a bulking device for the production of loop yarn, comprising a base forming a blowing chamber with a connection for blowing medium, a pin insert with a yarn feed channel aligned coaxially to the bulking device axis extending into the blowing chamber, which pin insert has a conically pointed pin, as well as a jet insert with a yarn delivery channel extending from the opposite end into the blowing chamber with a conical taper on the inlet side, followed by a diffusor connected to the smallest cross section thereof, whereby the conically pointed bulking pin extends into the conical taper of the jet insert.

A bulking device of this type is described in U.S. Pat. No. 3,577,614. To improve the texturing effect of the bulking device, it is suggested therein to increase the asymmetry of the gas flow either by eccentric alignment of the conical tip of the pin or of the yarn feed channel with respect to the axis, and under certain conditions, also to have an eccentric alignment of the yarn delivery channel, whereby the inlet cross section and the outlet cross section of the diffusor are in eccentric alignment with the jet axis (cf. FIG. 2 of cited patent). It has been found that a bulking device of this type has a relatively high air consumption. Moreover, it permits only a relatively low overfeed rate, resulting in a limited loop formation effect.

The objective of the invention is to provide a bulking device, making possible a high yarn overfeed combined with low air consumption.

This purpose is met with a bulking device of the above described type, whereby the diffusor axis forms in otherwise known manner an angle with the jet axis and in that an essentially cylindrical channel segment whose axis is parallel to the jet axis is directly connected to the diffusor at the outlet side thereof.

It is described in U.S. Pat. No. 3,577,614 how to design the diffusor to have its axis forming an angle with the jet (FIG. 4). By rotating the diffusor insert, certain eccentricities of the injector element will be offset and undesirable eddy formations will be inhibited.

By the above mentioned deflecting of the diffusor segment, the asymmetry of the flow profile is considerably increased and is translated into a distinct improvement in efficiency. Higher overfeed rates, thus greter loop formation, at lower air consumptions are made possible thereby.

The optimum angle between diffusor axis and jet axis can be determined empirically by testing. Values between 1° and 5° yield, as a rule, favorable results; the angle should preferably amount in otherwise known manner to between 2° and 3°.

In a preferred version of the bulking device of the invention, the inlet cross section of the diffusor is concentric with respect to the jet axis and its outlet cross section is eccentric with respect to the jet axis. In this version, the yarn delivery duct has two breaks, which further enhance the efficiency.

Favorable results are also provided by a bulking device of the invention, whereby the inlet cross section of the diffusor is in eccentric alignment and its outlet cross section in concentric alignment with the jet axis. In this version, the conical taper at the inlet end of the yarn delivery channel may be in concentric alignment with the jet axis or in eccentric alignment therewith.

Indeed, for further improvement of the efficiency, the bulking pin or the yarn feed channel provided therein, and/or the funnel-shaped taper of the yarn delivery channel, may be in eccentric alignment with the jet axis or other measures known in prior art to create asymmetrical flow conditions for instance, grinding the pin on one side will create asymmetrical flow conditions.

It is especially advantageous to have the diffusor connected directly to the conical taper and not have it separated therefrom by a cylindrical segment.

BRIEF DESCRIPTION OF THE DRAWINGS

The invention is explained with reference to the Figures, wherein.

DETAILED DESCRIPTION OF THE DRAWINGS

Figure 1:
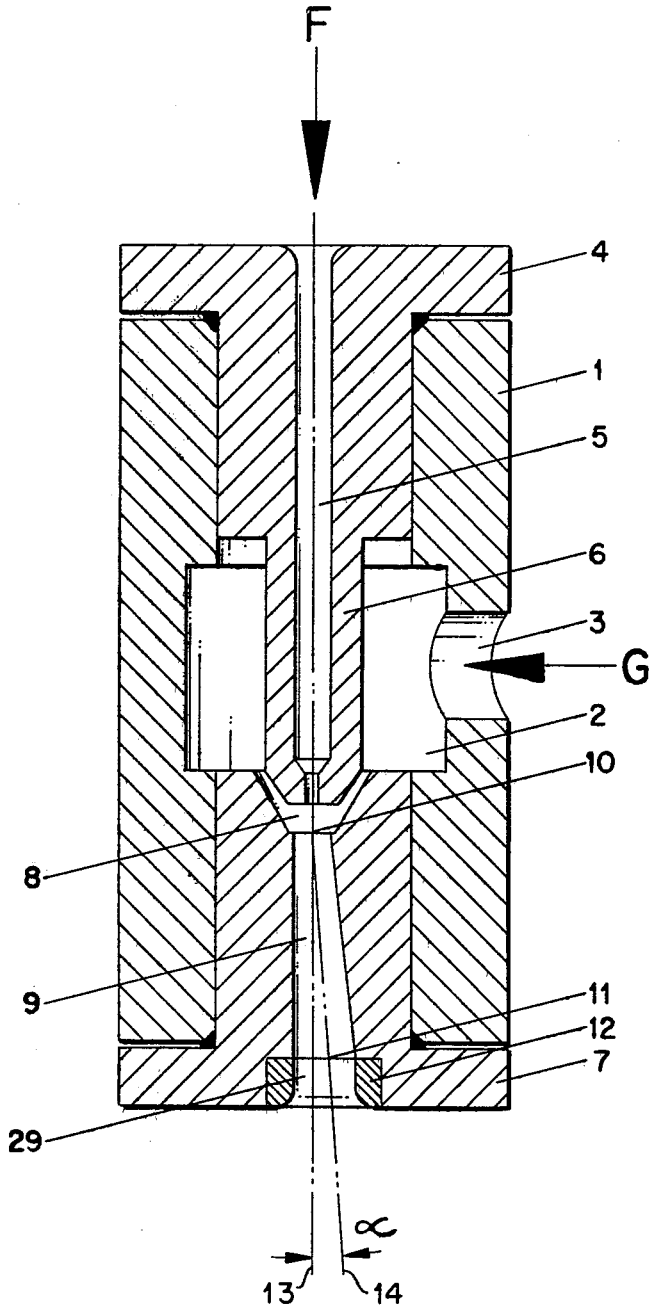
FIG. 1 illustrates a bulking device with a sloping diffusor, whose inlet cross section is in concentric alignment and its outlet cross section in eccentric alignment with respect to the jet axis.

FIG. 1 shows a bulking device base 1 with blowing chamber 2 and opening 3 for a blowing medium arriving from the direction of arrow G. On the input side of base 1, a pin insert 4 with conically pointed pin 6 is inserted. Yarn feed channel 5 is provided in this pin insert 4, through which channel filament yarn is fed in the direction of arrow F to the blowing chamber 2. Likewise inserted in base 1, but from the opposite end, is jet insert 7. The latter is provided with a yarn delivery channel with on its inlet side—here in concentric alignment with jet axis 13—a conical taper 8, immediately followed by a diffusor 9 and connected immediately thereto a cylindrical channel segment 29.

According to the invention, the diffusor is aligned at an angle $\alpha$ ("alpha") of preferably 2° to 3° with jet axis 13, whereby the point of intersection of the diffusor axis 14 with the jet axis 13 is located in the inlet cross section 10 of diffusor 9, which is concentric to jet axis 13. The essentially cylindrical channel segment 29 consists preferably of a mouth piece 12 inserted from the end into jet insert 7, the axis of said mouth piece being parallel but staggered with respect to jet axis 13. The axis of mouth piece 12 and diffusor axis 14 intersect in the outlet cross section 11 diffusor 9 at an angle corresponding to angle "alpha".

The bulking device shown in FIG. 1 has a yarn delivery channel with two breaks. Other bulking device elements, especially bulking pin 6 and yarn feed channel 8, do not exhibit any particular eccentricity.

Figure 2:
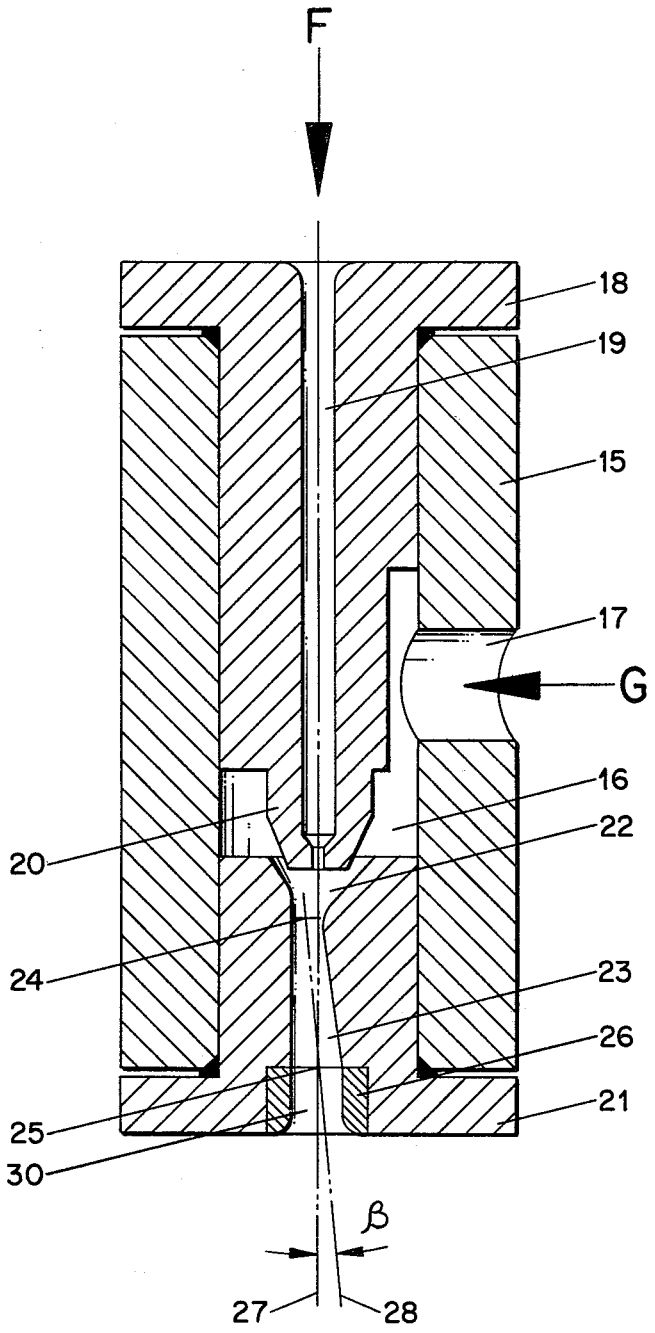
FIG. 2 illustrates a bulking device with a sloping diffuser whose inlet cross section is in eccentric alignment and its outlet cross section in concentric alignment with respect to the jet axis.

In the version of the bulking device shown in FIG. 2, base 15 is designed as in FIG. 1. It comprises a blowing chamber 16 and has an opening 17 to supply a blowing medium, e.g., compressed air, arriving from the direction of arrow G. Inserted at one end of base 15 is a pin insert 18, having a yarn feed channel 19 through which a filament bundle is transported in the direction of arrow F to the blowing treatment. Pin insert 18 has only a short pin 20, but in the zone of aperture 17 is uniformly ground on one side to add to the asymmetry of the flow. Jet insert 21, inserted from the opposite end into base 15, has a yarn delivery channel (not further identified) with on the inlet side—here again in concentric alignment with the jet axis 27—a conical taper 22, with immediately connected thereto a sloping diffusor 23 and immediately connected thereto an essentially cylindrical channel segment 30, whose axis coincides with jet axis 27. Diffusor axis 28 and jet axis 27 intersect here at an angle $\beta$ ("beta") in the outlet cross section 25 of diffusor 23, the inlet cross section 24 of the diffusor being in eccentric alignment with jet axis 27 and extending in the mantle of conical taper 22. Here again, the cylindrical channel segment 30 consists of a mouthpiece 26 inserted into the end of jet insert 21.

EXAMPLE I

With a bulking device according to FIG. 1, a 72 filament polyethylene terephthalate bundle having a dtex 340 can be processed to outstanding loop yarn at texturing speeds of 120 to 180 mpm and compressed air of 10 bar (before the jet) at a consumption rate of 10.6 $Nm^3/hr$ and 30% overfeed. The maximum feasible overfeed at 150 mpm, 8 bar and 8.2 $Nm^3/hr$ air consumption is 64%.

EXAMPLE II

By contrast, with a bulking device according to FIG. 2 of U.S. Pat. No. 3,577,614, the air consumption at comparable overfeed rates is 16.8 $Nm^3/hr$ and 13.3 $Nm^3/hr$, respectively.

EXAMPLE III

With a bulking device according to FIG. 2 of the enclosed drawings, the air consumption at 8 bar can be reduced to 5.8 $Nm^3/hr$ for a maximum feasible overfeed of 174%.

We claim:

1. A bulking device for the production of loop yarn, comprising a jet base having an inlet section and outlet section and a blowing chamber intermediate said inlet section and outlet secion, and means for connecting a blowing medium to said blowing chamber; a pin insert in said inlet section having a conically pointed tip extending through said blowing chamber, said pin insert having a yarn feed channel extending therethrough axially to the jet base; a jet insert in said outlet section having a conical taper aligned with said pointed tip of the pin insert, followed in order by a diffusor section forming a channel to said blowing chamber the axis of the diffusor section being angularly positioned to the jet axis, the diffusor section having a cylindrical channel segment at the outlet side thereof, the axis of the segment being parallel to but offset from said jet axis.

2. Bulking device according to claim 1 wherein the angle between the jet axis and the diffusor axis is between 2° and 3°.

3. Bulking device according to claims 1 or 2, wherein the inlet cross section of the diffusor section is concentric with respect to the jet axis and its outlet cross section is eccentric with respect to the jet axis.

4. Bulking device according to claim 3, wherein the diffusor section is connected directly to the conical taper.

* * * * *